US005449867A

United States Patent [19]

Kelaita, Jr. et al.

[11] Patent Number: 5,449,867

[45] Date of Patent: Sep. 12, 1995

[54] CIRCUIT BREAKER OPERATING HANDLE INTERLOCK

[75] Inventors: Joseph B. Kelaita, Jr., Bristol; Roger N. Castonguay, Terryville; Edwin J. Collin, Southington, all of Conn.

[73] Assignee: General Electric Company, New York, N.Y.

[21] Appl. No.: 258,005

[22] Filed: Jun. 10, 1994

Related U.S. Application Data

[62] Division of Ser. No. 100,400, Aug. 2, 1993, Pat. No. 5,349,145.

[51] Int. Cl.[6] ..... H01H 9/28

[52] U.S. Cl. ..... 200/43.14; 411/401

[58] Field of Search ..... 200/43.14, 43.15, 43.11, 200/43.13, 43.21, 43.16; 411/401, 400

[56] References Cited

U.S. PATENT DOCUMENTS

| | | | |
|---|---|---|---|
| 2,246,457 | 6/1941 | Schultz | 411/401 |
| 4,554,421 | 11/1985 | Grunert et al. | 200/43.15 |
| 4,978,816 | 12/1990 | Castonguay | 200/43.14 |
| 5,324,897 | 6/1994 | Melgoza et al. | 200/43.11 |

FOREIGN PATENT DOCUMENTS

| | | | |
|---|---|---|---|
| 2390569 | 1/1979 | France | 200/43.11 |

*Primary Examiner*—Renee S. Luebke

*Attorney, Agent, or Firm*—Richard A. Menelly

[57] ABSTRACT

A molded case circuit breaker handle interlock unit is arranged on the top surface of the circuit breaker to lockingly prevent intentional displacement of the circuit breaker operating handle from either the ON or OFF positions. The movable clip on the unit is attached to the circuit breaker handle to prevent tampering.

6 Claims, 6 Drawing Sheets

CIRCUIT BREAKER OPERATING HANDLE INTERLOCK

This is a divisional of application Ser. No. 08/100,400, filed Aug. 2, 1993 now U.S. Pat. No. 5,349,145.

BACKGROUND OF THE INVENTION

Circuit breakers in industrial environments are often locked in an OFF condition to allow a mechanic to repair the associated equipment without fear that the circuit breaker would be turned on to energize the equipment.

To prevent unauthorized use of electric power utility companies lock the circuit breaker operating handles in their OFF positions to prevent connection with the utility power system. It has been discovered that most circuit breaker locking arrangements can be defeated whereby the operating handles are turned on to use the power and later turned off to avoid detection.

U.S. Pat. No. 5,113,043 describes a circuit breaker handle interlock unit that interacts with the circuit breaker trip-test button to insure that the circuit breaker contacts are open when the operating handle is locked in the OFF position.

U.S. Pat. No. 4,897,515 describes a circuit breaker handle locking arrangement that secures part of the locking arrangement to an opening in the operating handle.

U.S. Pat. No. 4,733,029 discloses another circuit breaker operating handle locking unit that attaches part of the unit to the circuit breaker operating handle.

Some prior art circuit breaker handle interlock units however, can be defeated by moving the circuit breaker operating handle to the ON position and later moving the operating handle back to the OFF position, without visible indication of tampering.

It would be valuable to the electrical industry to insure reliance upon circuit breaker operating handle interlock units for both safety and economic considerations. Since it appears that the inherent circuit breaker design makes it impossible to prevent tampering, it would be extremely valuable to alert the utility company that such tampering has occurred.

Accordingly, one purpose of the invention is to describe a circuit breaker operating handle locking arrangement whereby the operating handle can be locked in either an ON or OFF position without displacement unless evidential tampering has occurred.

SUMMARY OF THE INVENTION

A circuit breaker operating handle locking unit allows the circuit breaker operating handle to be locked in its ON and OFF positions. A cam-follower arrangement is fastened to the operating handle and is positioned on a cam-shaped support positioned on a top surface of the circuit breaker. The unit also prevents unauthorized access to the circuit breaker rating plug, accessories and the trip-test button.

DESCRIPTION OF THE PREFERRED EMBODIMENT

Figure 1:
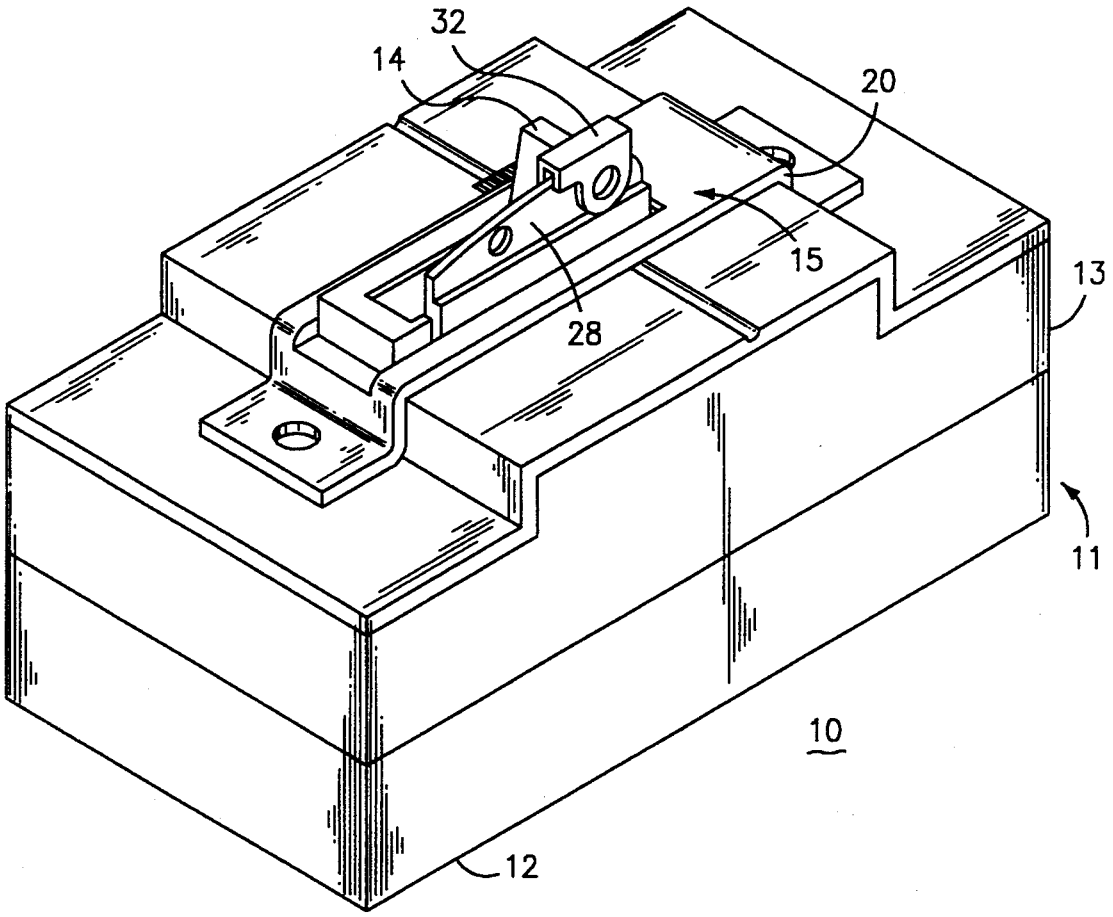
FIG. 1 is a top perspective view of a molded case circuit breaker with the handle operator locking unit of the invention attached to a top surface.

The locked circuit breaker 10 shown in FIG. 1 consists of a molded case circuit breaker 11 having a case 12 which contains the internal circuit breaker operating component and a cover 13 which contains the circuit breaker accessories. The circuit breaker is described within U.S. Pat. No. 4,754,247 entitled" Molded Case Circuit Breaker Accessory Enclosure". The circuit breaker handle locking unit 15 is arranged on a top surface of the cover and is attached in part to the circuit breaker operating handle 14 in the manner to be described below in detail. The unit includes a cam follower in the form of a U-shaped clip 32 and a cam in the form of a curved ramp 28 upstanding from the base 20.

Figure 2:
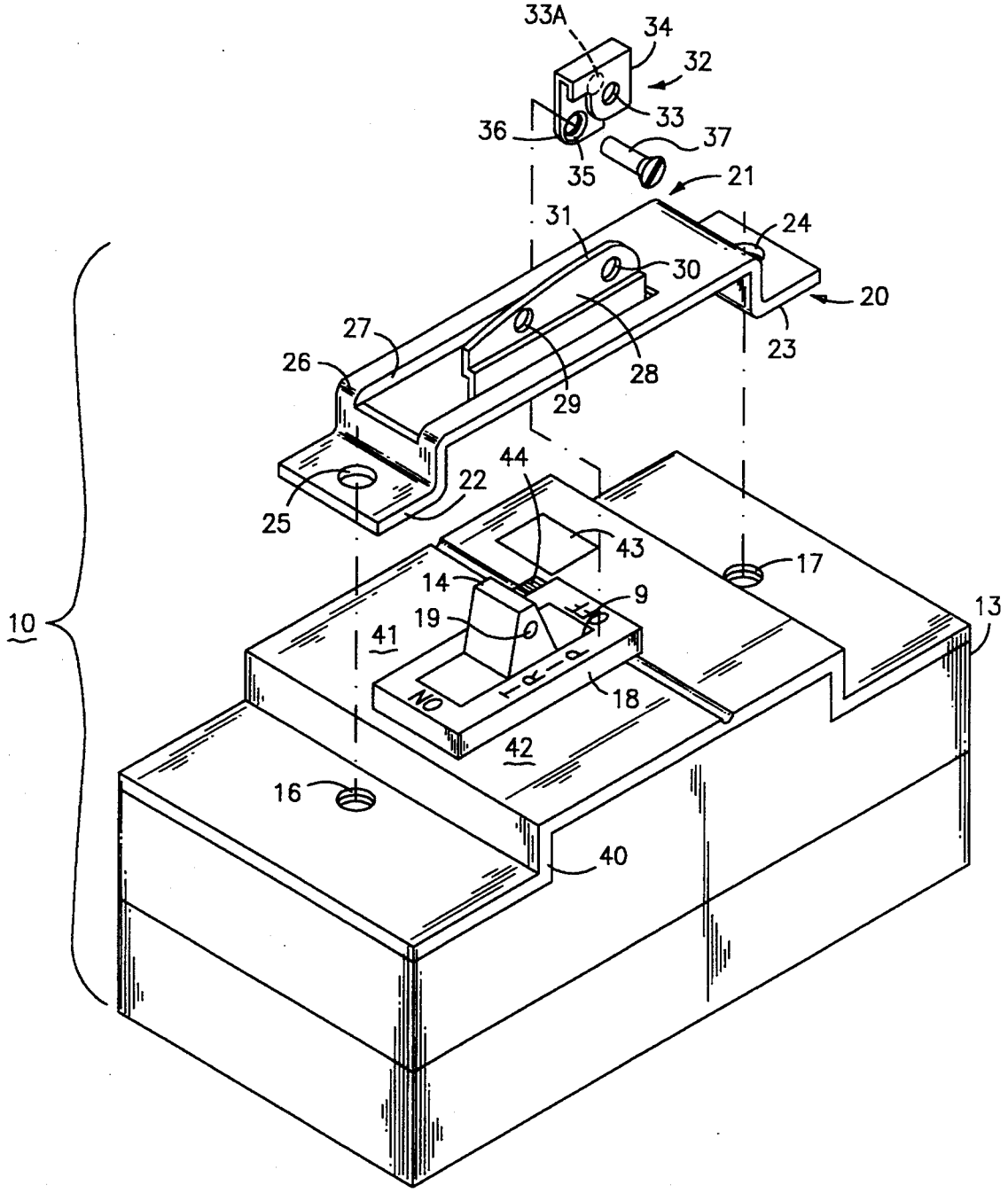
FIG. 2 is a top perspective view of the circuit breaker of FIG. 1 prior to attaching the handle operator locking unit.
Figure 3:
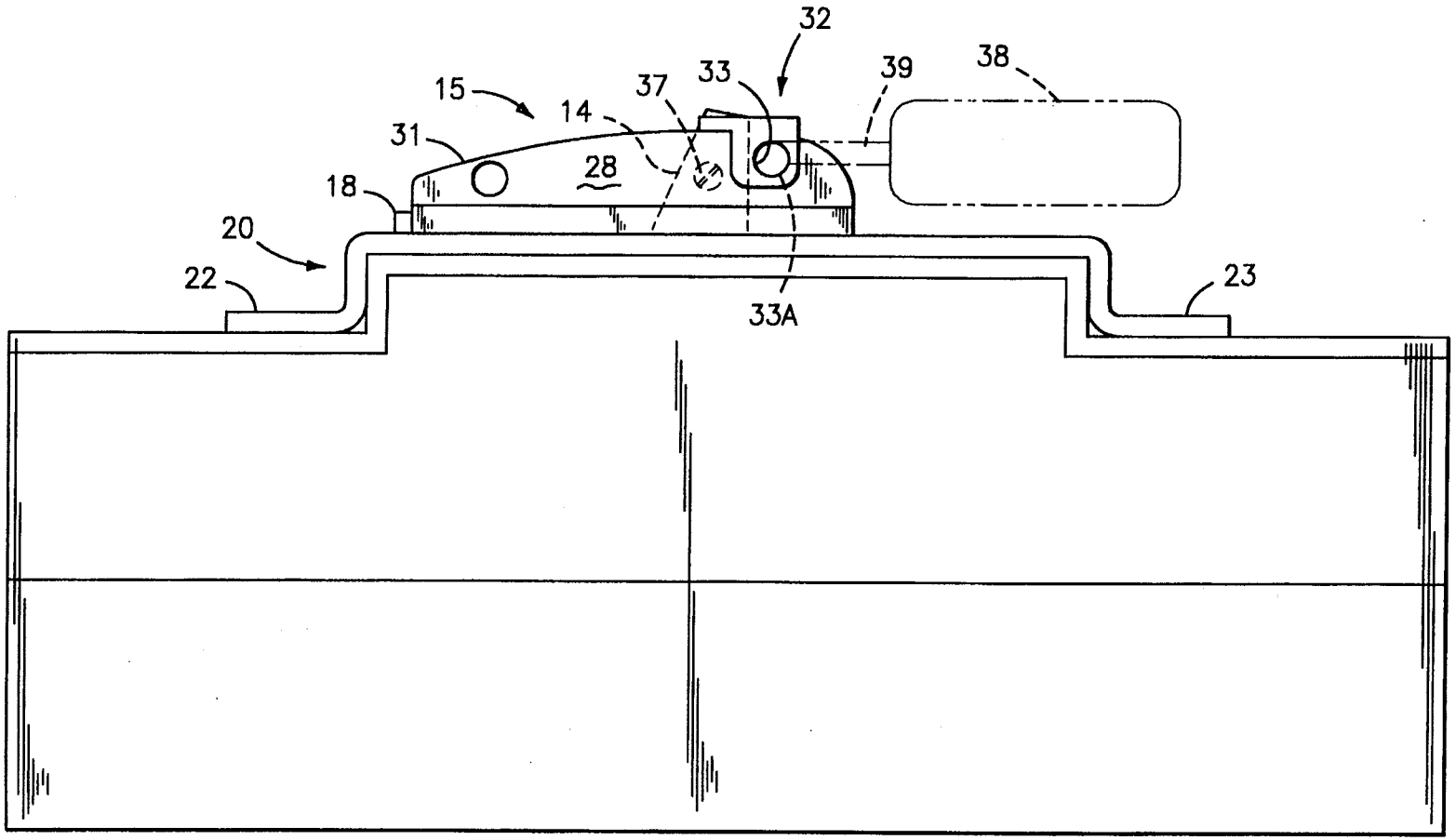
FIG. 3 is a side view of the circuit breaker of FIG. 1 with the handle operator locked in an OFF position.

The locked circuit breaker 10 is depicted in FIG. 2 prior to attaching the base 20 and the clip 32 in order to detail the configuration of the top surface of the circuit breaker and the interaction between the illustrated circuit breaker components and the base 20. As described in the aforementioned U.S. Pat. No. 4,754,247, the circuit breaker operating handle 14 extends upwards through the elongated slot 9 centered within the escutcheon 18. The operating handle allows external access for turning the circuit breaker between its ON and OFF conditions. The accessory cover 40 houses the circuit breaker accessories arranged within the cover and are accessed by means of the accessory doors 41,42. The trip-test button 44 is described in U.S. Pat. No. 4,740,768 entitled "Manual Test Operator for Molded Case Circuit Breakers". An externally-accessible rating plug 43 for setting the circuit breaker ampere rating is positioned next to the trip-test button and is described in U.S. Pat. No. 4,728,914 entitled "Rating Plug Enclosure for Molded Case Circuit Breakers". Threaded openings 16,17 provide optional means for attaching the base 20 to the top surface of the circuit breaker cover 13. The base is in the form of a U-shaped strap 21 defining a top bight surface 26 with opposing off-set ends 22,23. The openings 24,25 allow for the insertion of screws or other fastening means within the threaded openings 16, 17. The elongated slot 27 receives the circuit breaker operating handle 14 and allows translation of the handle between its ON and OFF positions. When the handle locking unit is positioned on the top surface of the circuit breaker cover, the sides of the base overlap part of the accessory doors and part of the rating plug to prevent access to the accessories within the cover and to prevent removal of the rating plug. The trip-test button is completely covered by the base and cannot be either seen or operated unless the base is removed. The curved ramp 28 is lanced from the base and is positioned upstanding from the base. The openings 29,30 in the ramp allow for the insertion of a padlock 38 (FIGS. 3,4) to lock the handle 14 in OFF and ON positions respectively. The ramp provides a guiding surface 31 to the U-shaped clip 32 for controlled motion of the clip when positioned next to the operating handle and fastened to the handle by means of the screw 37, small opening 35 in the rear leg 36 of the clip and the thru-hole 19 formed in the handle. The large openings 33, 33A in the front leg 34 and rear leg 36 of the clip accommodates the link 39 of the padlock 38 as best seen by now referring to FIGS. 3 and 4.

To lock the circuit breaker operating handle 14 in the OFF position the large openings 33, 33A in the clip 32 on the locking unit 15 is positioned adjacent the opening 30 (FIG. 2) in the ramp 28. The ends 22,23 interfere with the opposing edges of the escutcheon 18 to prevent lateral movement of the base 20 in an attempt to move the operating handle away from the OFF position to defeat the locking unit 15. A further important feature of the invention, is the design of the camming surface 31 to follow the arcuate motion of travel of the operating handle 14. If an attempt is made to lift the end 23 and move the base 20, clip 32 and operating handle 14 to the ON position, the clip bottoms out against the camming surface as the operating handle attempts to move in its arcuate path. It is further noted, that the attachment screw 37 is inaccessible for removal from the operating handle since the front and rear legs 34,36 (FIG. 2) on the clip 32 straddle the ramp 28 and prevent access to the screw 37 to prevent removal.

Figure 4:
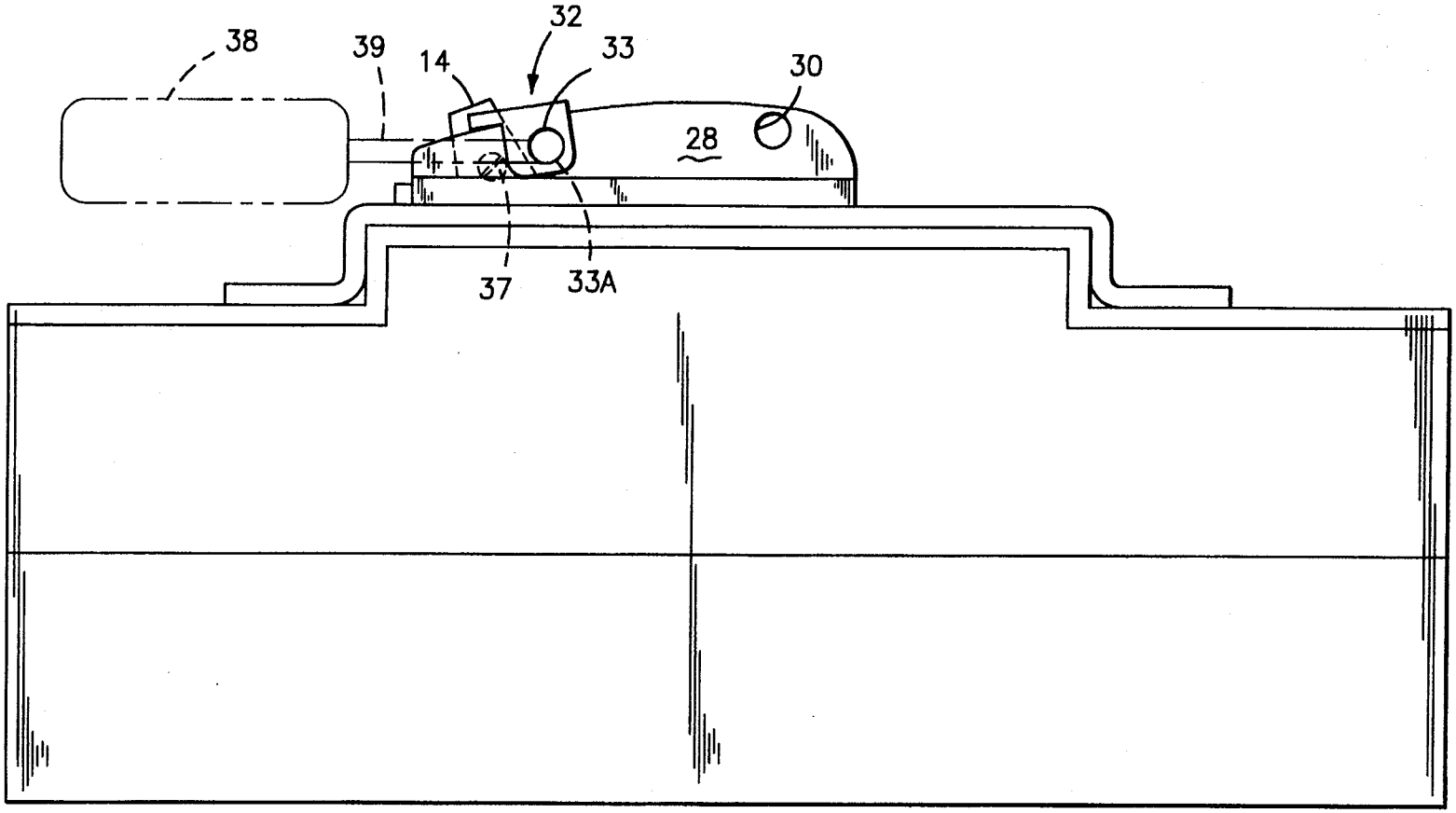
FIG. 4 is a side view of the circuit breaker of FIG. 1 with the handle operator locked in an ON position.

Removing the padlock 38 allows the clip 32 and operating handle 14 to be moved to the ON position shown in FIG. 4. The handle is locked in the ON position by insertion of the padlock link 39 on the padlock 38 through the large openings 33, 33A in the clip and through the opening 29 (FIG. 2). With the operating handle locked in the ON position, the ramp 28 blocks access to the screw 37 that secures the clip to the operating handle to prevent removal.

Figure 5:
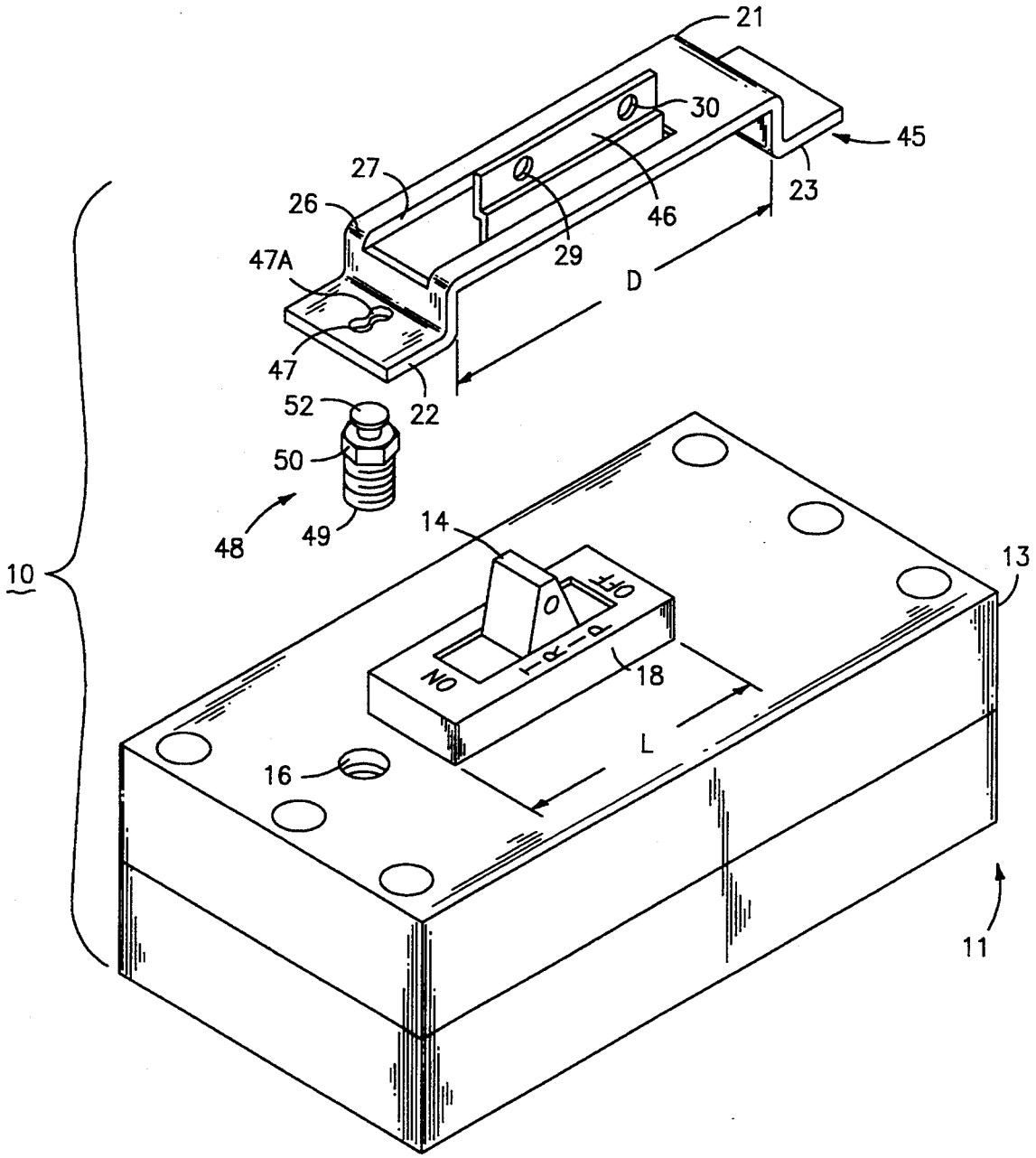
FIG. 5 is a top perspective view of the circuit breaker of FIG. 1 prior to attaching an alternative embodiment of the locking unit according to the invention.
Figure 6:
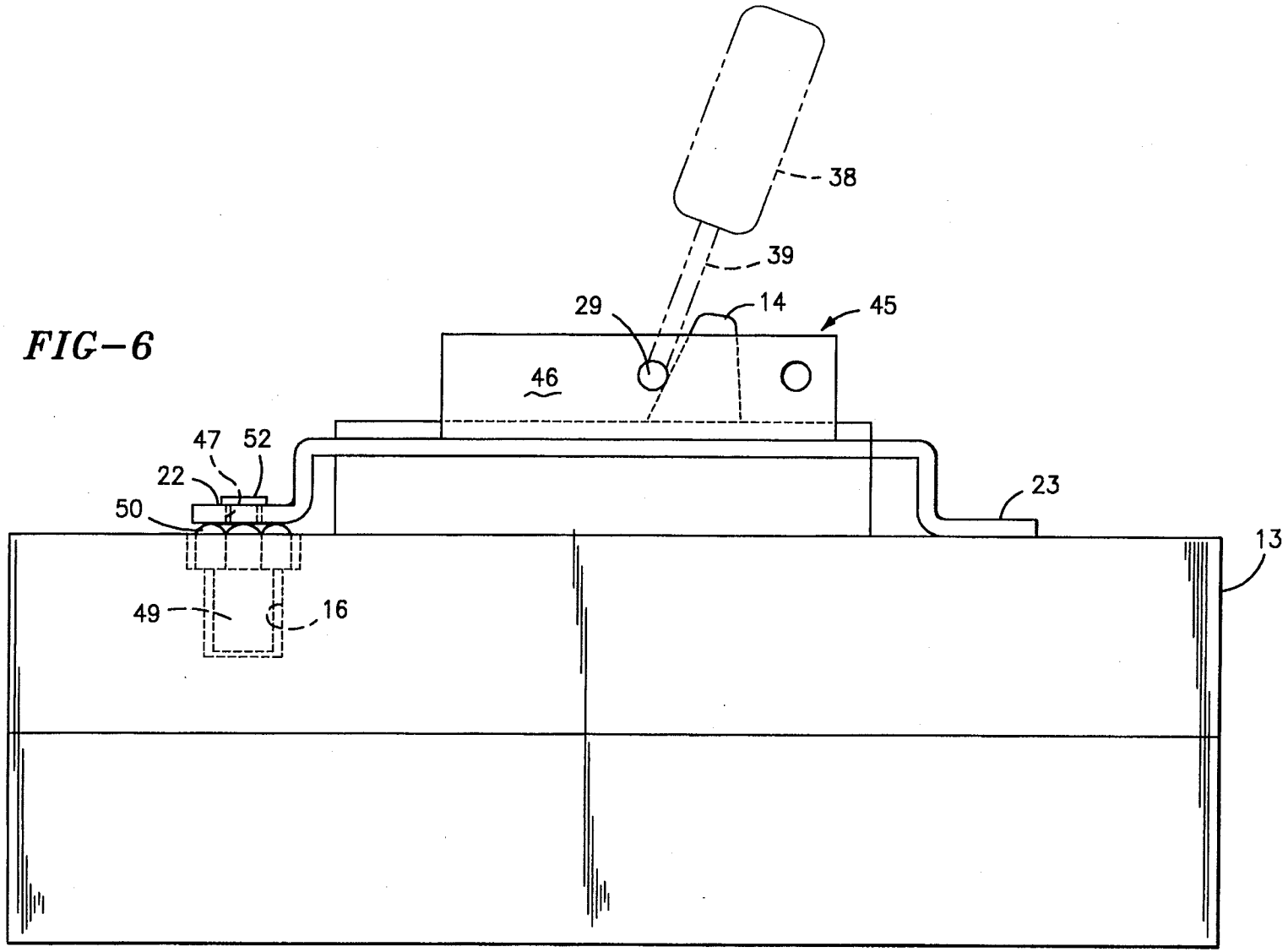
FIG. 6 is a side view of the circuit breaker of FIG. 5 with the alternative locking unit attached.

A simplified locking unit 45 is shown in FIG. 5 prior to attaching to the circuit breaker 11 to form a locked circuit breaker 10. The locking unit is similar to that of FIG. 2 and similar reference numerals will be used to depict similar elements, where possible. A U-shaped strap 21 having a top bight 26 and a central elongated slot 27 with off-set ends 22,23 is arranged on the top surface of a circuit breaker cover 13. Although a similar configuration as shown in FIG. 2 can be used with the additional features of the locking unit 45, the simplified U-shaped strap is lanced to shape a rectangular tang 46 with a similar pair of openings 29, 30. A keyhole-shaped slot 47 is formed in end 22 for attaching the unit to the circuit breaker cover in combination with a special locking screw 48 and the threaded opening 16 formed in the circuit breaker cover 13. An additional slot can also be formed in the end 23 if desired. The locking screw 48 is tightened within the threaded opening 16 by means of a hex tool fitted over the hex-shaped exterior 50 outboard the central stud 52 and engaging the threaded shank 49 within the threaded opening 16 in the cover 13. With the locking screw 48 threaded within the threaded opening 16, the stud 52 extends above the surface of the cover 13. The locking unit is then arranged over the escutcheon 18 with the stud captured within the keyhole slot 47. To allow relative motion between the unit and the escutcheon, the distance D between the ends 22, 23, is larger than the length L of the escutcheon. The unit is moved forward such that the stud 52 sits in the narrow end 47A of the keyhole slot 47 and the padlock link 39 on the padlock 38 is inserted within the opening 29 in the tang 46 to maintain the operating handle 14 in the OFF position as shown in FIG. 6. Still referring to FIG. 6 it is seen that the ends 22, 23 lie over the top surface of the circuit breaker cover 13. The stud 52 extends above the slot 47 and lockingly retains the end 22 against the circuit breaker cover. The head 50 and shank 49 within the opening 16 are captured under the end 22 and are inaccessible for removal of the locking unit 45. The padlock link 39 within the opening 29 interferes with the handle 14 when an attempt is made to slide the unit back within the keyhole slot 47. When this arrangement is used with the unit 20 of FIG. 2, the combined features make the locking unit of the invention virtually tamper proof such that any attempt to defeat the unit would cause damage to both the circuit breaker cover as well as the locking unit per se.

Simple and economically-feasible circuit breaker handle locking units have herein been described. The arrangement of an upstanding cam member to support a cam follower element that is attached to the circuit breaker handle prevents tampering with the unit without visible indication that the tampering has occurred. The addition of a keyhole slot and locking screw feature make the locking units virtually tamper-proof without indication of tampering.

We claim:

1. A handle locking unit for a molded case circuit breaker comprising:

a base plated adapted for positioning on a top surface of a circuit breaker cover:

an elongated rectangular slot formed in said base for receiving a circuit breaker operating handle, said elongated slot extending in a first direction for allowing motion of said circuit breaker operating handle within said slot;

a tang upstanding from said base plate and including a first opening corresponding to an OFF position of a circuit breaker operating handle;

a keyhole-shaped opening at one end of said base plate, said keyhole-shaped opening extending in said first direction; and means adapted for fastening said base plate to a circuit breaker cover, said fastening means comprising a threaded screw, having a first part receiving a fastening tool and a second part extending upward from said first part for inserting within said keyhole-shaped opening.

2. The handle locking unit of claim 1 wherein said base plate includes a pair of off-set ends.

3. The handle locking unit of claim 2 wherein said off-set ends are spaced apart a distance greater than a length of a circuit breaker cover escutcheon.

4. A molded case circuit breaker having a locked operating handle comprising:

a molded plastic cover fastened to a molded plastic case including internal circuit breaker operating components;

an operating handle extending upward from said cover providing means for turning said operating components between ON and OFF conditions;

a locking unit on said cover arranged for locking said operating handle between ON and OFF positions, said locking unit comprising a base plate adapted for positioning on a top surface of said circuit breaker cover;

an elongated rectangular slot formed in said base for receiving said circuit breaker operating handle, said elongated slot extending in a first direction for allowing motion of said circuit breaker operating handle within said slot;

a tang upstanding from said base plate and including a first opening corresponding to ON or OFF position of said circuit breaker operating handle;

a key-hole shaped opening at one end of said base plate, said keyhole-shaped opening extending in said first direction; and means adapted for fastening said base plate to said circuit breaker cover, said fastening means comprising a threaded screw, having a first part receiving a fastening tool and a second part extending upward from said first part for inserting within said keyhole-shaped opening.

5. The molded case circuit breaker of claim 4 wherein said base plate includes a pair of off-set ends.

6. The molded case circuit breaker of claim 5 wherein said off-set ends are spaced apart a distance greater than a length of an escutcheon on said circuit breaker cover.

* * * * *